US005983423A

United States Patent [19]

Rupe

[11] Patent Number: 5,983,423

[45] Date of Patent: Nov. 16, 1999

[54] FURNITURE BOX SPRING AND METHOD

[75] Inventor: Danny L. Rupe, Corona, Calif.

[73] Assignee: Alpine Engineered Products, Inc., Pompano Beach, Fla.

[21] Appl. No.: 08/921,000

[22] Filed: Aug. 29, 1997

Related U.S. Application Data

[62] Division of application No. 08/554,813, Nov. 7, 1995, Pat. No. 5,701,653.

[51] Int. Cl.[6] ..... A47C 19/00; A47C 23/06

[52] U.S. Cl. ..... 5/236.1; 5/200.1

[58] Field of Search ..... 5/400, 200.1, 236.1, 5/191

[56] References Cited

U.S. PATENT DOCUMENTS

| | | | |
|---|---|---|---|
| 3,080,576 | 3/1963 | Cervisi | 5/400 |
| 3,605,141 | 9/1971 | Silverman | 5/200.1 |
| 3,842,451 | 10/1974 | McCormick | 5/200.1 |
| 4,074,372 | 2/1978 | Schulz, Jr. | 5/263 |
| 4,391,008 | 7/1983 | Yamaoka et al. | 5/200.1 |
| 4,437,234 | 3/1984 | Thornton | 29/798 |
| 4,535,494 | 8/1985 | Diamonstein | 5/400 |
| 4,549,838 | 10/1985 | Birckhead | 403/405.1 |
| 4,734,946 | 4/1988 | Saputo | 5/400 |
| 5,095,605 | 3/1992 | Tonus | 29/798 |
| 5,099,529 | 3/1992 | Anderson | 5/400 |
| 5,144,706 | 9/1992 | Walker | 5/400 |
| 5,285,720 | 2/1994 | Wright | 29/432 |
| 5,469,589 | 11/1995 | Steed et al. | 5/400 |
| 5,564,140 | 10/1996 | Shoenhair et al. | 5/400 |

*Primary Examiner*—Alexander Grosz
*Attorney, Agent, or Firm*—Crutsinger & Booth

[57] ABSTRACT

A furniture box spring frame for manufactured for high volume production. The furniture box spring frame has a first side panel and a second side panel. Each of the side panels is interconnected by a plurality of connector plates. The panels are assembled using truss assembly technology, realizing an increased rate of production. A first connecting member extends from a first end surface of the first panel to a first end surface of the second panel. A second connecting member extends from the second end surface of the first panel to the second end surface of the second panel. A plurality of notches are correspondingly defined in each of the side panels along a top edge surface. A plurality of slats are received and secured to a bottom planar surface of each of the plurality of notches. The plurality of slats extend from the first side panel to the second side panel.

11 Claims, 6 Drawing Sheets

FURNITURE BOX SPRING AND METHOD

This application is a division of application Ser. No. 08/554,813, filed Nov. 7, 1995, now U.S. Pat. No. 5,701, 653.

TECHNICAL FIELD

This invention relates to a furniture box spring for beds. More particularly the invention relates to an improved furniture box spring and frame assembled therefore.

BACKGROUND OF THE INVENTION

High volume type box springs are commonly made using labor intensive techniques. These techniques consisted of assembly in piece meal fashion of a number of independent wooden members with a staple gun or the like. A level of skill was required to construct the box frame therefore requiring a certain amount of training before a worker was capable of effectively assembling the box frame to become profitable. These factors contribute undesirably to costs.

High volume production box springs typically are not highly rugged and in some instances are not capable of withstanding long-term use, thereby requiring frequent replacement. Additionally, conventional box springs are heavy which translates into additional shipping costs.

Thus, a need exists for a lightweight furniture box spring which can be quickly and easily manufactured for mass production while increasing the ruggedness and durability of the product. Such a device would reduce labor costs and thereby increase profitability.

SUMMARY OF THE INVENTION

A furniture box spring frame for high volume production is disclosed herein. The furniture box spring frame has a first side panel and a second side panel. Each of the side panels is assembled using a plurality of connector plates. The panels are assembled using truss assembly technology, realizing an increased rate of production. A first and a second connecting member extend from a first end surface of the first panel to a first end surface of the second panel. A third and a fourth connecting member extend from the second end surface of the first panel to the second end surface of the second panel. A plurality of notches are correspondingly defined in each of the side panels along a top edge surface. A plurality of slats are received and secured to a bottom planar surface of each of the plurality of notches. The plurality of slats extend from the first side panel to the second side panel.

Alternatively, a center panel is positioned between the first side panel and the second side panel to provide further support of the slats. The center panel has a generally rectangular cross-section formed by a first and a second end member and a top and a bottom beam joined together by a plurality of connector plates. The size of the center panel beams and members may be increased to support a greater amount of downward pressure.

Another aspect of the invention is a method of assembling the furniture box spring frame. At least two side panels, a plurality of connecting members and a plurality of slats are provided. The side panels are interconnected by the connecting members such that the at least two side panels are spaced apart and generally parallel to each other. The slats are attached across a top surface of the at least two side panels to form a generally planar surface.

A further aspect of the invention is a notch with diverging side planar surfaces to receive the slats. The notch has a substantially trapezoidal cross-section such that a first and a second side planar surface diverge from a bottom planar surface. In this respect, a slat is received in the notch and secured to the bottom planar surface without engaging the diverging side planar surfaces.

These and other features, advantages, and objects of the present invention will be apparent to those skilled in the art upon reading the following detailed description of preferred embodiments and referring to the drawing.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which.

DETAILED DESCRIPTION OF PREFERRED EMBODIMENT

Figure 1:
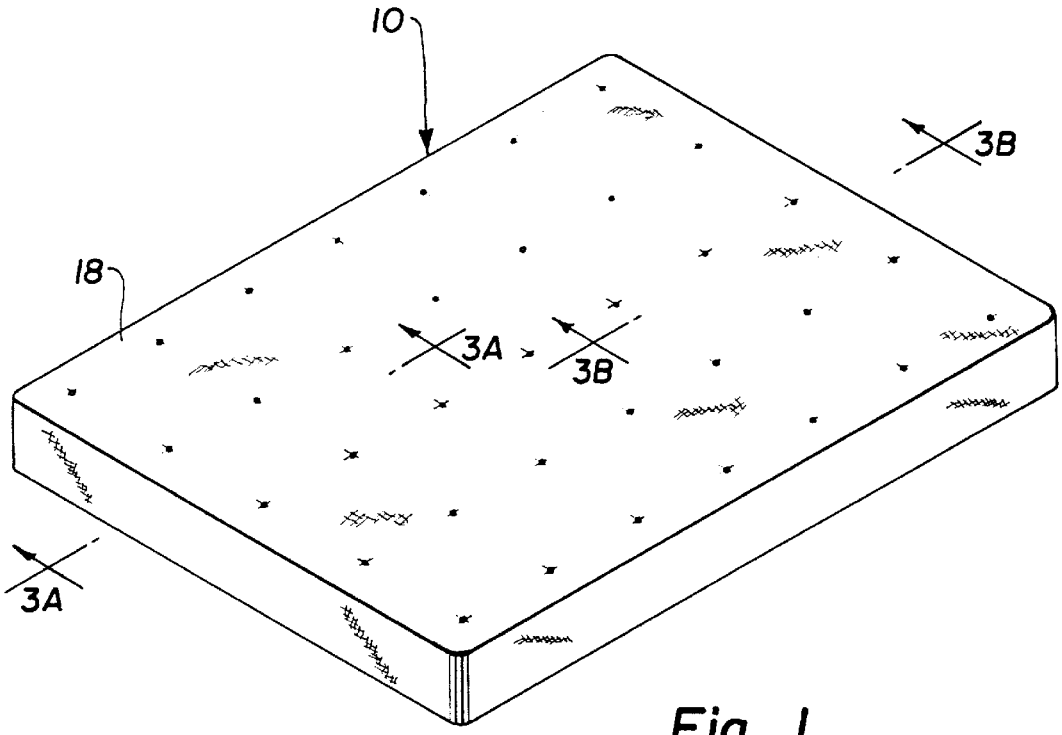
FIG. 1 is a perspective view of a box spring for a bed produced in accordance with the present invention.

Referring now to the drawing where like reference characters are used throughout the figures to refer to like parts, there is shown in FIG. 1 a form box spring generally designated by the numeral 10. The term "box spring" is used in the industry to refer to the bed component that is below and supports the mattress (not shown). In high volume beds the box spring component typically does not contain metallic springs.

Figure 2:
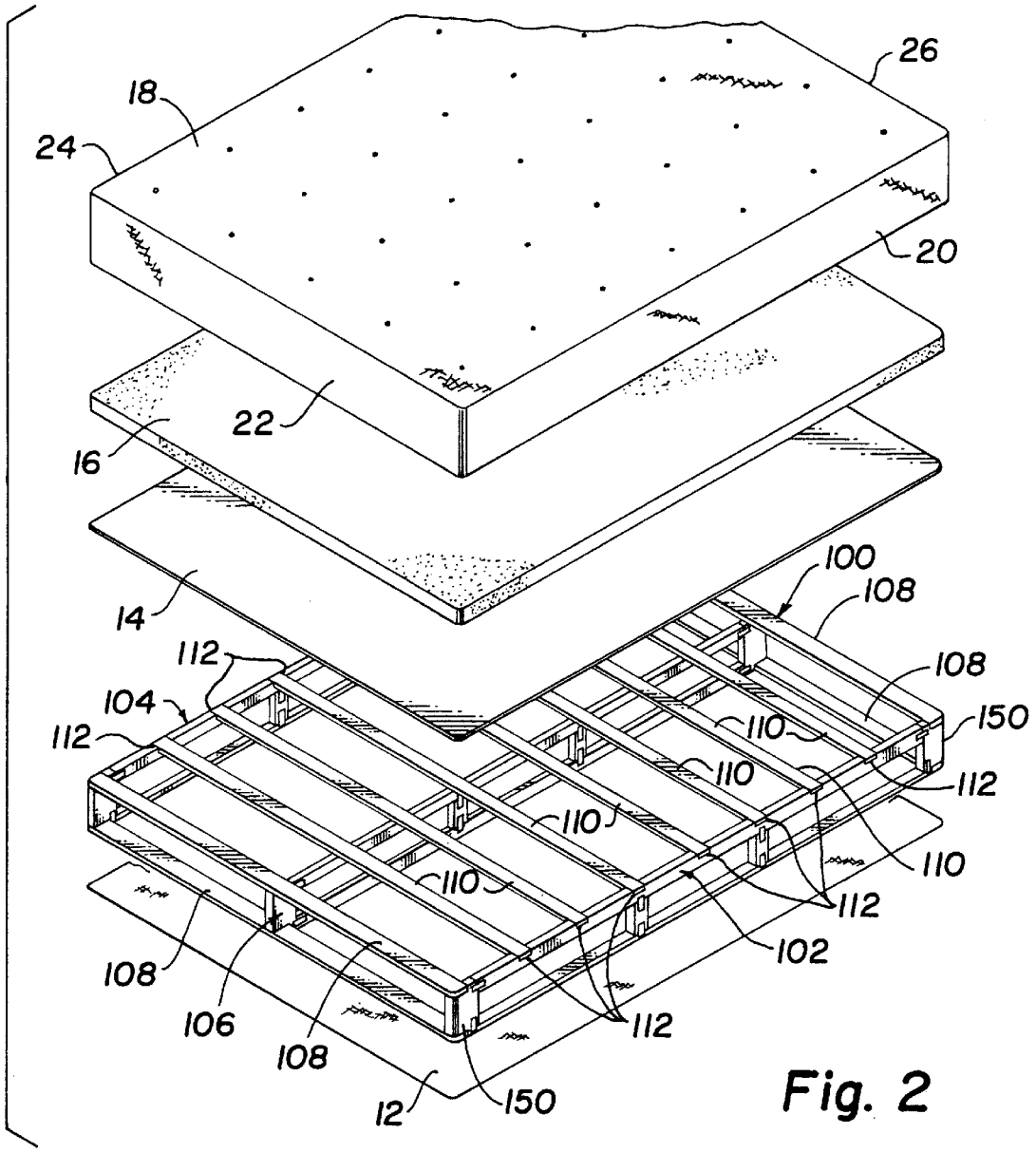
FIG. 2 is an exploded perspective view of the box spring illustrated in FIG. 1.

FIG. 2 illustrates typical components which form box spring 10. The support component is provided by frame 100, discussed later in detail. Typically attached to the bottom surfaces of frame 100 is ticking material 12 or the like. The ticking material is a breathable fabric used as a dust and insect barrier while allowing moisture to escape. Placed to the top surfaces of the frame 100 is a board 14. Board 14 is made of a material suitable to support the rest of the parts of the bed 10. Such a material is corrugated cardboard, masonite, particle board, or the like. Foam pad 16 rests on top of board 14. Covering the assembly is quilted cover 18 which has side surfaces 20, 22, 24 and 26, the bottoms of which are secured to the bottom of frame 100. Frame 100 is preferably made of a material having a predetermined combined amount of spring support to support objects placed or seated on box spring 10 without breaking. Such material typically has a grain pattern formed by fibers in the material which extends in the direction of a longitudinal axis of the material used. Such a suitable material is wood or plastic.

Figure 4:
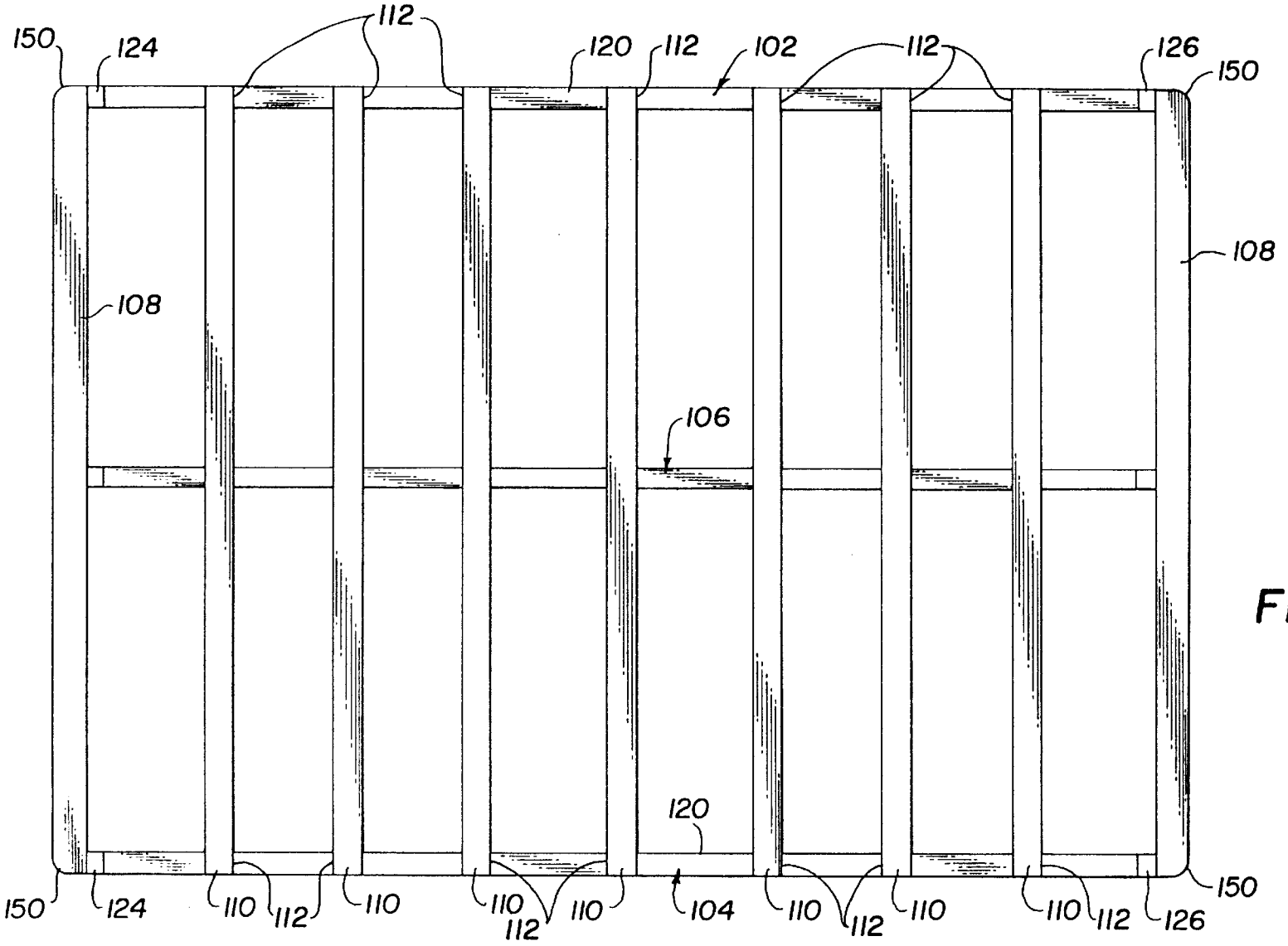
FIG. 4 is a top plan view of the box spring frame.

Frame 100 in the larger size beds has first side panel 102, second side panel 104, center panel 106 and upper and lower connecting members 108. In the smaller twin size bed the center panel can be eliminated. Each side panel 102 and 104 has a plurality of notches 112 spaced along the length of the side panel 102. The notches 112 are adapted to receive a plurality of slats 110 which extend between first side panel 102 and second side panel 104. The spacing between slats 110 is sufficient to maintain a generally planar surface when a generally downward force is exerted against frame 100. Center panel 106 provides additional support to the slats 110 when a downward pressure is applied to the surface plane defined by the slats 110. Frame 100 can be sized to accommodate common use sizes for furniture commonly available in the market. For example, the preferred embodiment provides an example of frame 100 used in a mattress. To accommodate the sizes presently available in the market, frame 100 can be sized to provide mattress sizes from twin to king without departing from the spirit and scope of the invention. Referring to FIG. 4, shown is an assembled frame 100. Rounded edges 150 are aligned with side panel 102 and 104 interconnecting members 108. Rounded edges 150 aid in the assembly by more readily allowing quilted cover 18 to be placed over the frame 10 shown in FIG. 2.

Figure 5:
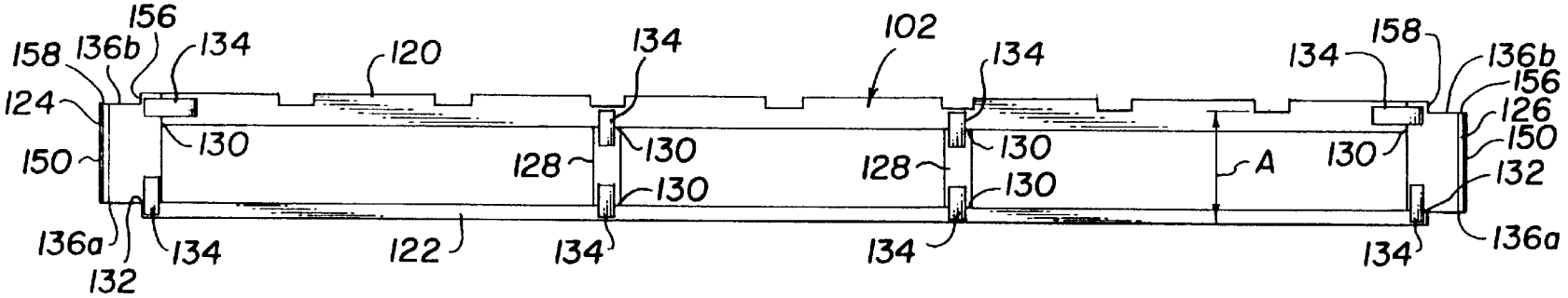
FIG. 5 is an elevation view of the side panel of the frame illustrated in FIG. 4.

In FIG. 5, details of the first side panel 102 are shown. Second side panel 104 is a mirror image of first side panel 102, thus the following description of first side panel 102 applies equally to second side panel 104. First side panel 102 comprises a top beam 120, a bottom beam 122, a first end member 124 and a second end member 126. Spaced between first and second end member 124 and 126, respectively, are braces 128. Top beam 120 and bottom beam 122 are about 1.75 inches (4.45 cm) in height by about 1.5 inches in width (3.81 cm). Top beam 120 is about seventy-two inches (182.88 cm) in length. Bottom beam 122 is about seventy-four inches (187.96) in length. Braces 128 are each about 1.75 inches (4.45 cm) in height by about 1.5 inches (3.81 cm) wide. End members 124 and 126 are made from a block of material being about two inches (5.08 cm) by about four inches (10.16 cm) by about 6.25 inches (15.88 cm). The beams and the members are placed together to form butt joints 130. Overlapping joints 132 are formed with bottom beam 122 and first and second end members 124 and 126, respectively, which forms rabbets **136*a* as shown in FIG. 5. A rabbet is defined as a recess cut out of the edge of any body, especially a body intended to receive another member, such as connecting members 108. Rabbets 136*b* are formed in the first and the second end members 124 and 126, respectively. Rabbets 136*a* are adapted to receive bottom connecting members 108 while rabbets 136*b* receive top connecting members 108 which in turn interconnect the first and the second side panels 102 and 104**, respectively.

Connector plates 134 are embedded in the first side panel 102 to secure the joints 130 and 132. The opposite side of first side panel 102 (not shown) has connector plates 134 (not shown) identically located and embedded for added rigidity of the assembly.

Figure 6:
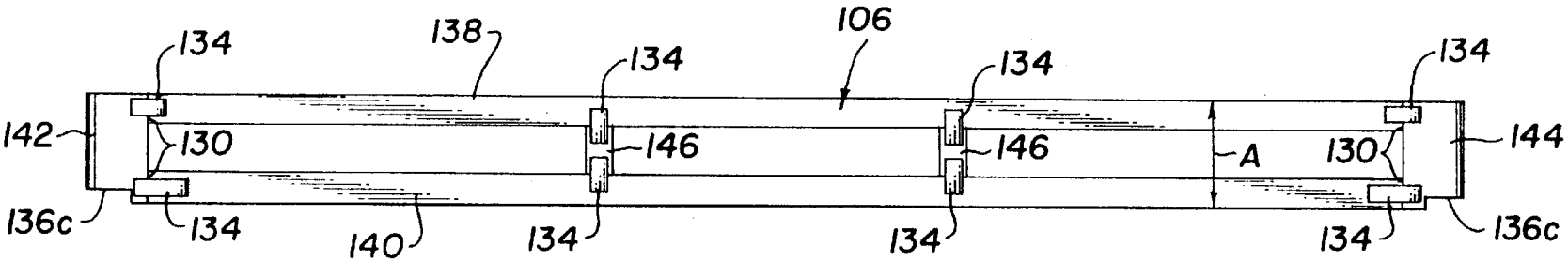
FIG. 6 is an elevation view of the center panel of the frame illustrated in FIG. 4.

Referring to FIG. 6, shown is the center panel 106. The center panel 106 comprises a top beam 138, a bottom beam 140, a first end member 142 and a second end member 144. Between first and second beam 138 and 140, respectively, are braces 146. Top beam 138 and bottom beam 140 are about 1.75 inches (4.45 cm) in height by about 1.5 inches in width (3.81 cm) by about seventy-two inches (182.88 cm) in length. Braces 146 are each about 1.75 inches (4.45 cm) in height by about 1.5 inches (3.81 cm) wide. A box spring 10 is typically supported and reinforced above a floor with a metal frame (not shown) supporting the perimeter of the box spring 10 while no additional reinforcement is provided for the center of box spring 10. Therefore, center panel 106 can be made of larger beams or multiple center panels 106 can be used for additional load support as necessary.

The beams and the members are placed together to form butt joints 130. Rabbets **136*c* are adapted to receive bottom connecting members 108 which interconnect the first and the second side panels 102 and 104, respectively. Connector plates 134 are embedded in the center panel 106 to secure the butt joints 130. The opposite side of center panel 106 (not shown) has connector plates 134** (not shown) identically located and embedded for added rigidity of the assembly.

Figure 3A:
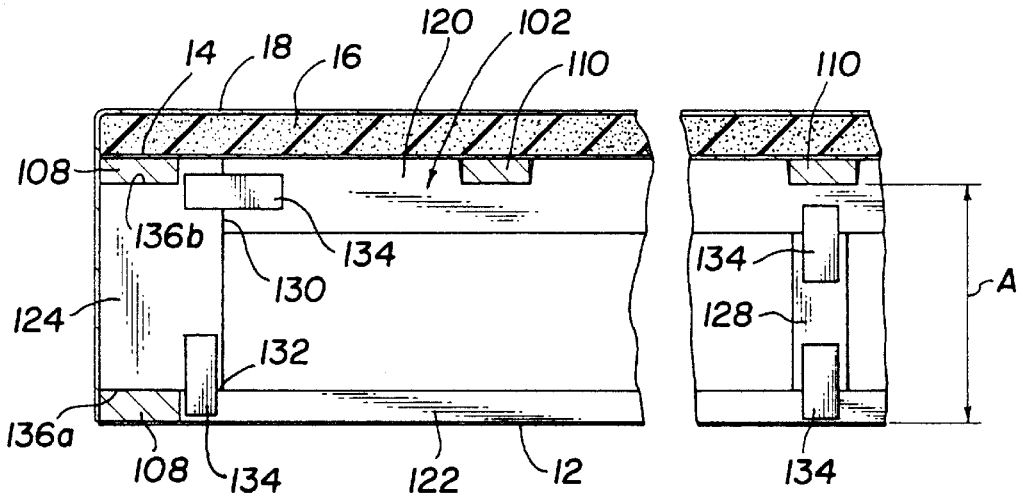
FIGS. 3A and 3B is an enlarged partial sectional view taken on line 3A—3A and 3B—3B of FIG. 1 looking in the direction of the arrows.
Figure 3B:
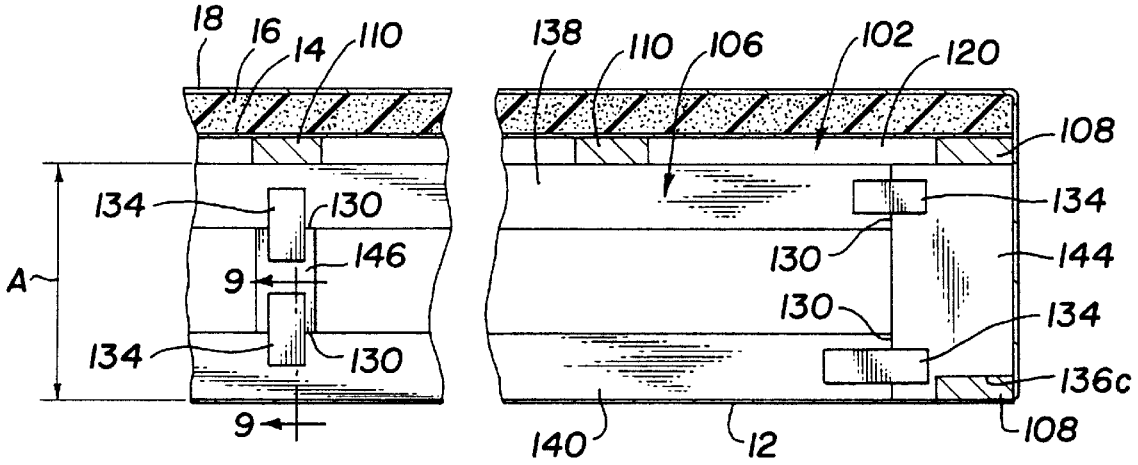

Height A shown in FIG. 6 corresponds with height A shown in FIG. 5. As best shown in FIG. 3, center panel 106 has a height sufficient to allow the slats 110 to lay adjacent to top beam 138. Top beam 138 of center panel 106 adds structural support to slats 110 when an object or person sits on frame 100. The slats 110 are secured to the center panel 106 using nails, staples or the like. Connecting members 108 are similarly secured to the panels 102, 104 and 106 (when the center panel is used).

Figure 7:
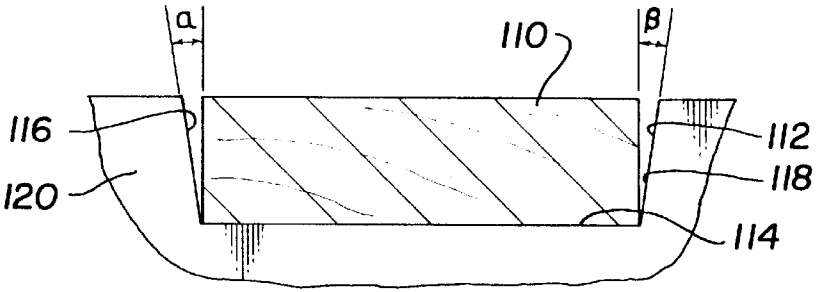
FIG. 7 is an enlarged view of one of the slots in FIG. 5 with a slat illustrated therein.

An enlarged detail of the plurality of notches 112 is shown in FIG. 7. The form of the notches 112 contributes to the strength and durability of the frame 100. As shown notch 112 has bottom planar surface 114, first side planar surface 116 and second side planar surface 118. The first and the second side planar surfaces 116 and 118 diverge from the bottom planar surface 114 by one-sixteenth of an inch (0.16 cm) on both sides at angles $\alpha$ and $\beta$, respectively, as determined with respect to the references provided by the sides of slat 110. The diverging sides 116 and 118 act to limit the frictional contact between upper beam 120 and slat 110. As a downward pressure is exerted against slat 110, the bottom planar surface 114 is distorted in response. The diverging sides 116 and 118 are diverted inward towards the slat 110 such that the downward pressure is absorbed and released by the bottom planar surface and diverging sides. Prior devices commonly absorb such energy and then it is released by a frictional slip between slat 110 and sides 116 and 118 which typically results in an annoying audible squeak.

First and second side panel members 102 and 104 and center panel member 106 can be assembled using truss assembly techniques. Using side panel 102 as an example, a template can be broadcast onto a work surface designating the proper placement of connector plates 134, top and bottom beams 120 and 122, respectively, first and second end members 124 and 126, respectively, and braces 128. When the components are in position, a gantry press can be used to embed connector plates 134 into the structure. Remaining side panel 104 and center panel 106 are each similarly assembled.

Figure 8:
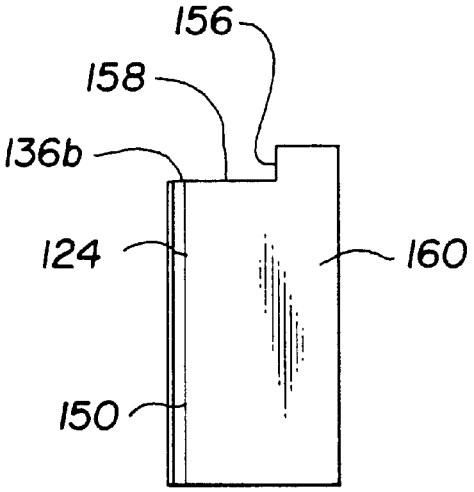
FIG. 8 is an enlarged view of one of the end members in FIG. 3A.

FIG. 8 is a detail of an end member 124. End member 124 has curved edge 150 and rabbet **136*b* to receive connecting member 108 (see FIG. 2). Side wall 156 is generally perpendicular to the rabbet bottom surface 158 to readily engage the connecting member 108. Inner side 160 provides a surface for interfacing with top and bottom beams 120 and 122, respectively. End member 144 of center panel 106 has a similar profile as end member 124 of side panels 102 and 104. However, end member 144 does not have the curved edge 150 and is oriented 180 degrees such that the rabbet 136***c* is oriented downwards.

Figure 9:
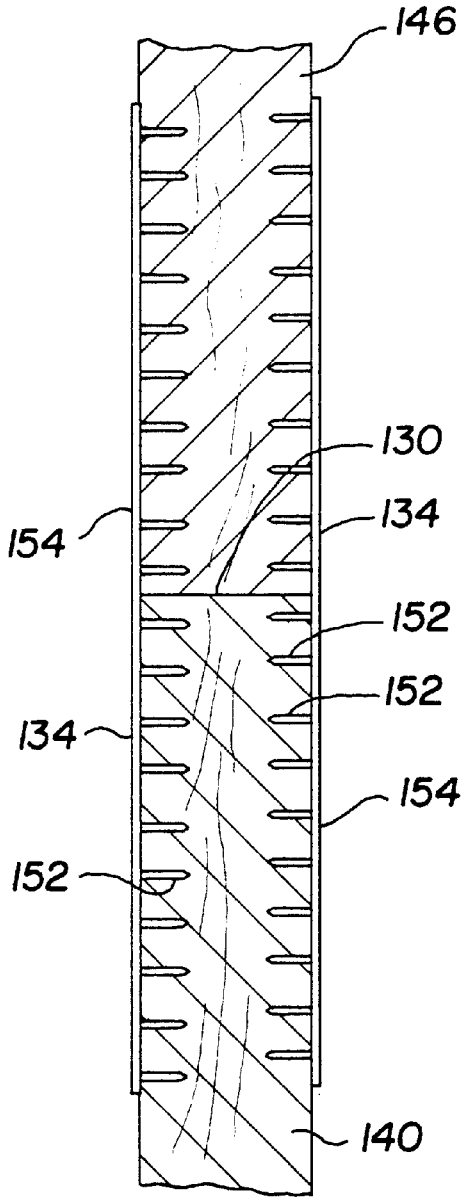
FIG. 9 is an enlarged sectional view taken on line 9—9 of FIG. 3B looking in the direction of the arrows.

Referring to FIG. 9, shown is a cross-section illustration showing connector plates 134 used to secure brace 146 and bottom beam 140 of center panel 106 together. As discussed above, connector plates 134 are placed on each side of a joint to provide rigidity to the joint. A plurality of spaced apart nail-like teeth 152 are integrally-formed in and extend from a base plate 154. The plurality of nail-like teeth 152 are embedded in the brace 146 and bottom beam 140 about butt joint 130 to secure the two members into a single unit. An example of a connector plate is shown in U.S. Pat. No. 4,549,838 issued to Birckhead.

The description and figures of the specific examples above do not point out what an infringement of this invention would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined in the following claims.

Having described the invention, what is claimed is:

1. A furniture box spring frame comprising:

at least two truss-assembled side panels having a top beam, a bottom beam, a first end piece and a second end piece;

a plurality of connector plates connecting said top beam and said bottom beam to said end pieces;

a plurality of connecting members interconnecting said at least two side panels such that said at least two side panels are spaced apart and generally parallel to one another; and a plurality of slats attached to a top surface of the at least two side panels to form a generally planar surface.

2. A furniture box spring frame as in claim 1, further comprising:

a center panel attached to said plurality of connecting members such that said center panel is substantially equidistant between the at least two side panels.

3. A furniture box spring frame as defined in claim 2 wherein:

said center panel has a first and a second end piece and a top and a bottom beam joined together by a plurality of connector plates.

4. A furniture box spring frame as defined in claim 1 wherein each said side panel comprises at least four separate members.

5. A furniture box spring frame as defined in claim 1 wherein each of said first and second side panels further comprise:

at least one brace spaced apart from each of the first and second end pieces of said first and said second side panels.

6. A furniture box spring frame as defined in claim 1 wherein for each of said at least two side panels:

a first end of the top beam forms a butt joint with the first end piece such that a first grain pattern of the top beam generally aligns with a second grain pattern of the first end piece, and a second end of the top beam forms a butt joint with the second end piece such that the first grain pattern of the top beam generally aligns with a third grain pattern of the second end piece.

7. A furniture box spring frame as defined in claim 6 wherein for each of said at least two side panels:

a top edge of the first end piece has a first rabbet adapted to receive one of said plurality of connecting members; and a top edge of the second end piece has a second rabbet adapted to receive another of said plurality of connecting members.

8. A furniture box spring frame as defined in claim 6 wherein for each of said at least two side panels:

the bottom beam has a first end jointed by the plurality of connector plates with a bottom edge of the first end piece such that an overlapping joint is formed with a first grain pattern of the bottom beam being generally oriented in the direction of the second grain pattern of the first end piece, the overlapping joint forming a first rabbet to receive one of said plurality of connecting members, and the bottom beam has a second end joined by the plurality of connector plates with a bottom edge of the second end piece such that an overlapping joint is formed with the first grain pattern of the bottom beam being generally oriented in the direction of a third grain pattern of the second end piece, the overlapping joint forming a second rabbet to receive another of said plurality of connecting members.

9. A furniture box spring frame as in claim 1, wherein the top surfaces of said at least two side panels define a plurality of spaced apart notches for receiving said plurality of slats.

10. A furniture box spring frame as in claim 9, wherein each said notch has diverging sides.

11. A furniture box spring frame comprising:

at least two truss-assembled side panels;

a plurality of connecting members interconnecting said at least two side panels such that said at least two side panels are spaced apart and generally parallel; and a plurality of slats attached to said at least two side panels, the top surfaces of said at least two side panels defining a plurality of notches for receiving said slats, each of said notches having diverging sides.

* * * * *

UNITED STATES PATENT AND TRADEMARK OFFICE

CERTIFICATE OF CORRECTION

PATENT NO. : 5,983,423
DATED : November 16, 1999
INVENTOR(S) : Danny L. Rupe

It is certified that error appears in the above-indentified patent and that said Letters Patent is hereby corrected as shown below:

On the Title Page

In the Abstract, line 1 delete "for", second occurrence;

In Column 1, line 10 delete "therefore" and insert -- therefor --;

In Column 1, line 47, delete "extend" and insert -- extends --;

In Column 2, line 28 delete "is" and insert -- are --;

In Column 3, line 27 delete "panel" and insert -- panels --;

In Column 3, line 28 after "104" insert -- and --;

In Column 3, line 42 delete "(187.96)" and insert -- (187.96 cm) --;

In Column 5, line 11 delete"integrally-formed" and insert -- integrally formed --.

Signed and Sealed this

Tenth Day of April, 2001

*Attest:*

Nicholas P. Godici

NICHOLAS P. GODICI

*Attesting Officer*

*Acting Director of the United States Patent and Trademark Office*